US007288209B2

(12) United States Patent
Hiramatsu et al.

(10) Patent No.: US 7,288,209 B2
(45) Date of Patent: Oct. 30, 2007

(54) TREATING AGENT FOR ELASTIC FIBERS AND ELASTIC FIBERS OBTAINED BY USING THE SAME

(75) Inventors: Masahiro Hiramatsu, Yao (JP); Takashi Soga, Yao (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 148 days.

(21) Appl. No.: 10/494,288

(22) PCT Filed: Oct. 30, 2002

(86) PCT No.: PCT/JP02/11272

§ 371 (c)(1),
(2), (4) Date: May 3, 2004

(87) PCT Pub. No.: WO03/038182

PCT Pub. Date: May 8, 2003

(65) Prior Publication Data

US 2005/0005366 A1 Jan. 13, 2005

(30) Foreign Application Priority Data

Nov. 2, 2001 (JP) ..... 2001-374965
Mar. 22, 2002 (JP) ..... 2002-125011

(51) Int. Cl.
*D06M 15/643* (2006.01)
*D06M 13/292* (2006.01)
*D06M 13/50* (2006.01)

(52) U.S. Cl. ..... 252/8.82; 57/225; 442/105

(58) Field of Classification Search ..... 8/115.51, 8/115.6, 115.55, 901; 252/8.82, 8.91; 57/225; 442/105

See application file for complete search history.

(56) References Cited

U.S. PATENT DOCUMENTS 4,496,631 A * 1/1985 Adachi et al. ..... 428/394
5,288,416 A * 2/1994 Petrea et al. ..... 252/8.81
5,595,675 A * 1/1997 Aso et al. ..... 252/8.61
6,353,049 B1 * 3/2002 Doi et al. ..... 524/432
6,406,788 B1 * 6/2002 Doi et al. ..... 428/364
6,428,892 B2 * 8/2002 Matsuhisa et al. ..... 428/367
6,652,599 B1 * 11/2003 Inuzuka et al. ..... 8/115.51
6,821,301 B2 * 11/2004 Azuse et al. ..... 8/115.51

FOREIGN PATENT DOCUMENTS

| | | | |
|---|---|---|---|
| EP | 0 900 876 A1 | | 10/1999 |
| JP | 03-294523 A | | 12/1991 |
| JP | 4-361667 A | | 12/1992 |
| JP | 9049167 | * | 8/1993 |
| JP | 7-173770 A | | 7/1995 |
| JP | 9217283 | * | 2/1996 |
| JP | 9-049167 A | | 2/1997 |
| JP | 405195442 | * | 2/1997 |
| JP | 9-217283 A | | 8/1997 |
| JP | 411061651 | * | 8/1997 |
| JP | 2000144578 | * | 11/1998 |
| JP | 11-229277 A | | 8/1999 |
| JP | 11229277 | * | 8/1999 |
| JP | 411229277 | * | 8/1999 |
| WO | 98/36112 | * | 8/1998 |
| WO | 00/09789 | * | 2/2000 |

* cited by examiner

*Primary Examiner*—Lorna M. Douyon
*Assistant Examiner*—Amina Khan
(74) *Attorney, Agent, or Firm*—Foley & Lardner LLP

(57) ABSTRACT

The present invention provides finishes for elastic fiber, which produce elastic fiber yarn having superior antistatic, unwinding, package buildup performance and lubricity properties. The present finishes further minimize fly sticking on the elastic fiber during the knitting operation of elastic fiber yarn and cotton spun yarn.

The finishes of the present invention contain 80 to 99.99 parts by weight of at least one base component selected from the group consisting of silicone oils, mineral oils and ester oils, 0.01 to 10 parts by weight of amino-modified silicones and 0.0001 to 10 parts by weight of phosphate esters containing an acidic hydroxyl group and at least one hydrocarbon or oxyalkylene group per molecule.

The elastic fiber of the present invention is characterized with the application of the finish in an amount of 0.1 to 15 weight percent of the fiber.

15 Claims, 3 Drawing Sheets

TREATING AGENT FOR ELASTIC FIBERS AND ELASTIC FIBERS OBTAINED BY USING THE SAME

FIELD OF INVENTION

The present invention relates to the finishes for elastic fiber and the fiber produced therewith. Precisely, it relates to the finishes for elastic fiber which attain superior antistaticity, lubricity, and unwinding and package buildup performances of elastic fiber yarn, minimize cotton fly deposit on elastic fiber yarn generated from rubbed cotton spun yarn in knitting or weaving of elastic fiber yarn and cotton yarn, and eliminate the ends down of elastic fiber yarn in knitting and weaving operation; and the elastic fiber produced therewith.

TECHNICAL BACKGROUND

A finish for melt-spun elastic fiber containing amino-modified silicones is described in Japanese Patent Laid-Open No. Sho 61-97471. A finish for elastic fiber containing both polyether-modified silicones and amino-modified silicones is described in Japanese Patent Laid-Open No. Hei 4-5277. A finish for elastic fiber containing organic phosphate salts is described in Japanese Patent Laid-Open No. Hei 7-173770.

Those conventional finishes cannot impart sufficient antistaticity to elastic fiber because they are formulated with hydrophobic base components, such as silicone oils, mineral oils and ester oils. Excessive stickiness at the contact between elastic fiber yarn strands causes poor unwinding performance of the elastic fiber yarn from packages. Improper friction at the contact between elastic fiber yarn strands causes poor package buildup. Optimum lubricity on yarn surface is necessary for constant operation in downstream processes. In the knitting operation of elastic fiber yarn combined with cotton spun yarn, cotton fly is apt to stick on elastic fiber yarn and deposit at a clearer guide that must be frequently cleaned to prevent ends down of elastic fiber yarn.

A finish containing a phosphate ester, alkyl amine having primary or secondary amino groups, and amino-modified silicone may be effective for preventing elastic fiber yarn strands from sticking to each other, because those components react with isocyanates contained in polyurethane polymer forming elastic fiber yarn and thus inhibit the reaction between isocyanates on the surface of elastic fiber yarn, the cause of the sticking of elastic fiber yarn strands. The alkyl amines and amines contained in the amino-modified silicones may irritate skin and must be carefully handled. The phosphate esters are almost ineffective by themselves for imparting antistaticity, lubricity, and package buildup performance and inhibiting cotton fly sticking on elastic fiber yarn.

The object of the present invention is to provide the finishes for elastic fiber, which attain superior antistaticity, lubricity, and unwinding and package buildup performances of elastic fiber yarn, minimize cotton fly sticking on elastic yarn in knitting or weaving of elastic fiber yarn and cotton yarn, and attain high-speed knitting operation, for example, with 100 m/min or higher yarn feeding speed, of fine elastic yarn, for example, monofilament of 33 dtex or finer, and cotton yarn; and the elastic fiber produced therewith.

DISCLOSURE OF INVENTION

The inventors of the present invention have studied on the solution of the problems mentioned above, and found that they can be solved with the following compositions.

The present invention is attained with (1) to (5) described below.

(1) Finishes for elastic fiber containing from 60 to 99.99 parts by weight of at least one of base components selected from the group consisting of silicone oils, mineral oils and ester oils, 0.01 to 20 parts by weight of an amino-modified silicone and 0.0001 to 20 parts by weight of a phosphate ester containing one or more of hydrocarbon groups or oxyalkylene groups per a molecule.

(2) The finishes according to (1) mentioned above, wherein 80 to 99.99 parts by weight of the said base component, 0.01 to 10 parts by weight of the said amino-modified silicone and 0.0001 to 10 parts by weight of the said phosphate ester are contained.

(3) The finishes according to (1) mentioned above or (2), wherein 0.01 to 15 parts by weight of one or more of those selected among polyether-modified silicones, carboxy-modified silicones, metallic soaps and silicone resins is contained.

(4) The finishes according to (1), (2) or (3) mentioned above, wherein the mole ratio of the amino groups in the said amino-modified silicone to the acidic hydroxyl groups in the said phosphate ester ranges from 0.8 to 1.2.

(5) Elastic fiber applied with one of the finishes described in the above (1), (2), (3) or (4) by 0.1 to 15 weight percent of the fiber.

Figure 1:
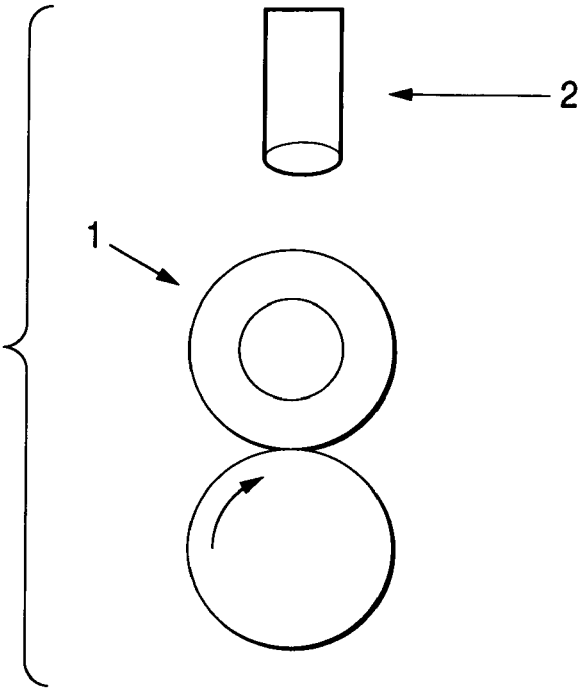
FIG. 1 is the schematic illustrating the determination of static charge by roller.

The numbers in the figures indicate the parts, samples and checking points: 1 a package of elastic fiber yarn, 2 Kasuga electric potentiometer, 3 a package of elastic fiber yarn, 4 elastic fiber yarn, 5 a compensator, 6 pulleys, 7 knitting needles, 8 a strain gauge, 9 a pulley, 10 a speedometer, 11 a winding roller, 12 Kasuga electric potentiometer, 13 a load, 14 pulleys, 15 a strain gauge, 16 a package of elastic fiber yarn, 17 a compensator, 18 a pulley, 19 a clearer guide for cotton fly, 20 a winding roller for elastic fiber yarn, 21 a package of cotton spun yarn, 22 yarn guide, 23 pulleys, 24 knitting needles, 25 a winding roller for cotton spun yarn, 26 a package of elastic fiber yarn, 27 a bobbin for yarn winding, 28 an unwinding roller, 29 a winding roller, 30 yarn to be wound, 31 unwinding point, and 32 a contact point between package and unwinding roller.

BEST MODE OF EMBODIMENT

The finishes of the present invention contain 60 to 99.99 parts by weight, preferably 80 to 99.99 parts by weight, of at least one of base components selected from the group consisting of silicone oils, mineral oils and ester oils. The examples of the silicone oils are dimethyl silicone and methylphenyl silicone, the examples of the mineral oils are liquid paraffin of Redwood 40 sec, liquid paraffin of Redwood 50 sec, liquid paraffin of Redwood 60 sec and liquid paraffin of Redwood 80 sec, and the examples of the ester oils are isooctyl laurate, isooctyl stearate, isopropyl palmitate and butyl stearate.

A finish containing base components in a ratio lower than the above-mentioned ratio cannot dissolve the amino-modified silicones and phosphate esters into a stable solution. On the other hand, a finish containing the base component in a ratio higher than the above-mentioned ratio cannot impart the performances attained by amino-modified silicones and phosphate esters, such as antistaticity, proper unwinding and package buildup performance, lubricity, and effect of preventing cotton fly sticking on elastic yarn, sufficiently to elastic fiber.

The finishes of the present invention contain 0.01 to 20 parts by weight, preferably 0.1 to 10 parts by weight, of amino-modified silicones.

Less than 0.01 parts by weight of amino-modified silicones in a finish cannot attain sufficient antistaticity, unwinding performance, package buildup performance, lubricity and effect of preventing fly sticking on elastic yarn; and more than 20 parts by weight of amino-modified silicones in a finish cannot dissolve in base component well.

The amino-modified silicones blended in the finishes of the present invention are those having one or more of amino groups per a molecule and those having a viscosity from 30 to 30,000 $mm^2/s$ at 25° C. and an amine value from 0.1 to 200 KOHmg/g are preferable.

Amino-modified silicones having a viscosity less than 3 $mm^2/s$ are apt to evaporate, and those having a viscosity more than 30,000 $mm^2/s$ impart poor lubricity to fiber. Preferable viscosity of the amino-modified silicones ranges from 3 to 20,000 $mm^2/s$.

Amino-modified silicones having an amine value less than 0.1 KOHmg/g impart insufficient antistaticity, lubricity, and unwinding and package buildup performance, and do not effectively prevent fly sticking on yarn, and those having an amine value more than 200 KOHmg/g cannot dissolve in base components sufficiently. Preferable amine value of the amino-modified silicones ranges from 1 to 150 KOHmg/g.

The said amino-modified silicones are polyorganosiloxane containing terminal or side-chain amino groups.

The amino groups contained in the said amino-modified silicones are those represented by the formulae; $—R_1NHR_2NH_2$ (where $R_1$ and $R_2$ are divalent hydrocarbon groups), $—R_3NH_2$ (where $R_3$ is a divalent hydrocarbon group), $—R_4NHR_5$ (where $R_4$ is a divalent hydrocarbon group and $R_5$ is a monovalent hydrocarbon group), and $—R_6NR_7R_8$ (where $R_6$ is a divalent hydrocarbon group, and $R_7$ and $R_8$ are monovalent hydrocarbon groups).

The finishes of the present invention contain 0.0001 to 20 parts by weight, preferably 0.0001 to 10 parts by weight, of phosphate esters containing one or more of hydrocarbon or oxyalkylene groups per a molecule.

Less than 0.0001 parts by weight of phosphate esters in a finish imparts insufficient antistaticity, lubricity, and unwinding and package buildup performance, and do not effectively prevent fly sticking on yarn, and more than 20 parts by weight of phosphate esters in a finish cannot dissolve sufficiently in base components.

The preferable hydrocarbon groups for the phosphate esters employed in the present invention are saturated or unsaturated and branched or linear aliphatic hydrocarbon groups containing 1 to 30 carbon atoms in average, or aromatic hydrocarbon groups or cyclic aliphatic hydrocarbon groups that may have substituents.

The preferable phosphate esters employed in the present invention are those having 1 to 30 oxyalkylene groups, such as oxyethylene, oxypropylene and oxybutylene groups. Phosphate esters having more than 30 oxyalkylene groups cannot dissolve sufficiently in base components.

The examples of the said phosphate esters are monomethyl phosphate, dimethyl phosphate, trimethyl phosphate, trioctacosanyl phosphate, oleyl phosphate, 2-ethylhexyl phosphate, butyl phosphate, benzyl phosphate, octylphenyl phosphate, cyclohexyl phosphate, POE (5) cetyl phosphate, POE (7) POP (3.5) secondary alkylether phosphate, and POE (2) POP (5) phosphate.

The preferable mole ratio of the amino groups in the said amino-modified silicones to the acidic hydroxyl groups in the said phosphate esters is from 0.5 to 1.5. A mole ratio lower than 0.5 is not economical, because the amount of acidic hydroxyl groups for neutralizing amino groups is excessive for a required amount. A mole ratio greater than 1.5 may lead to skin irritation due to amines from non-neutralized amino groups. The preferable mole ratio is from 0.8 to 1.2.

The finishes of the present invention are safe and do not irritate skin, because the amino groups in the said amino-modified silicones are neutralized. The neutralized amino groups with the said phosphate esters react with isocyanates on elastic fiber yarn surface to prevent elastic fiber yarn strands from sticking to each other, because isocyanates are more reactive with amino groups than the phosphate esters. In addition, the acidic hydroxyl groups of phosphate esters also react with isocyanates on elastic fiber yarn surface to prevent elastic fiber yarn strands from sticking to each other, though the reactivity of the acidic hydroxyl groups is lower than that of the amino groups. Such performance contributes to improved unwinding performance of elastic fiber yarn from packages.

At least one of those selected among the group consisting of modified silicones except amino-modified silicones, especially polyether-modified silicones and carboxy-modified silicones, metallic soaps, and silicone resins can be added in the finishes of the present invention by 0.01 to 15 parts by weight, preferably by 0.01 to 5 parts by weight.

The metallic soaps to be added in the finishes are those of higher fatty acids, already known to those skilled in the art as one of the components for conventional finishes for elastic fiber. Among those, aluminum stearate, calcium stearate, magnesium stearate, barium stearate, and zinc stearate are preferable.

The modified silicones to be blended in the finishes are those known to those skilled in the art except amino-modified silicones, for example, alkyl-modified silicones, ester-modified silicones, polyether-modified silicones, carbinol-modified silicones, carboxy-modified silicones, mercapto-modified silicones, phosphate-modified silicones and epoxy-modified silicones. Among those, polyether-modified silicones and carboxy-modified silicones are preferable.

The silicone resins to be blended in the finishes are organopolysiloxane resins comprising siloxane units represented by the formula, $R_1R_2R_3SiO_{1/2}$ (where $R_1$, $R_2$ and $R_3$ are monovalent hydrocarbon groups), and siloxane units represented by the formula, $SiO_2$; organopolysiloxane resins comprising siloxane units represented by the formula, $R_1R_2R_3SiO_{1/2}$ (where $R_1$, $R_2$ and $R_3$ are monovalent hydrocarbon groups), siloxane units represented by the formula, $SiO_2$, and siloxane units represented by the formula, $R_4SiO_{3/2}$ (where $R_4$ is a monovalent hydrocarbon group); and organopolysiloxane resins comprising siloxane units represented by the formula, $R_4SiO_{3/2}$ (where $R_4$ is a monovalent hydrocarbon group).

Furthermore, several components usually blended in the finishes for elastic fiber, such as stabilizers, antistatic agents, antioxidants, and ultraviolet lay absorbers, can be blended in the finishes of the present invention.

The preferable viscosity of the finishes of the present invention at 30° C. ranges from 3 to 30 $mm^2/s$. A finish having a viscosity less than 3 $mm^2/s$ will evaporate excessively and that having a viscosity more than 30 $mm^2/s$ may not impart sufficient lubricity to fiber.

The elastic fiber of the present invention is characterized by the application of the said finishes by 0.1 to 15 weight percent, preferably 1 to 10 weight percent.

EXAMPLES

The present invention is described specifically with the following examples. Each of the properties mentioned in the examples was evaluated in the procedure described below.

Procedure for Testing Finish Performance

Viscosity:

The kinetic viscosity of a finish sample was determined with a Cannon-Fenske viscometer at a fixed temperature, such as 25° C. or 35° C.

Amine Value:

The amine value of a finish sample was determined by titrating a finish sample dissolved in a solvent, such as isopropyl alcohol, with potentiometric titration with 0.1 N—HCl-ethyleneglycol-isopropyl alcohol solution.

Static Charge by Roller:

On the unwinding roller, (1) a package of finish-applied elastic fiber yarn was placed as illustrated in FIG. 1, and the unwinding roller was rotated with a peripheral velocity of 50 m/min. The static charge generated on the package 1 hour after the starting of the rotation was determined with (2) a Kasuga electric potentiometer 2 cm above the package.

Figure 2:
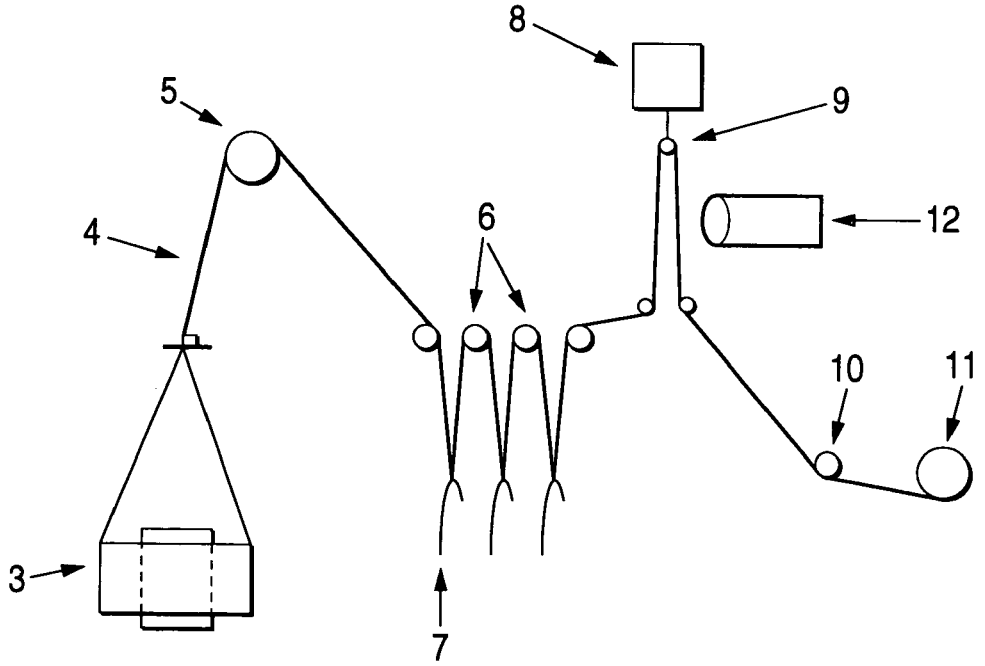
FIG. 2 is the schematic illustrating the determination of yarn tension in knitting operation and static charge on yarn.

Yarn Tension in Knitting Operation:

As illustrated in FIG. 2, (4) elastic fiber yarn was released vertically from (3) a package, driven through (5) a compensator, (6) pulleys, (7) knitting needles, (9) a pulley attached to (8) a strain gauge, (10) a speedometer, and wound onto (11) a winding roller. The yarn was driven at a fixed and constant speed (for example, 10 m/min and 100 m/min) that was controlled with the rotational speed of the winding roller and was wound onto the winding roller. The tension on the running yarn was determined with (8) the strain gauge, for indicating the friction between the yarn and the knitting needles in grams. The static charge on yarn was simultaneously determined with (12) a Kasuga electric potentiometer 1 cm above the running yarn.

Figure 3:
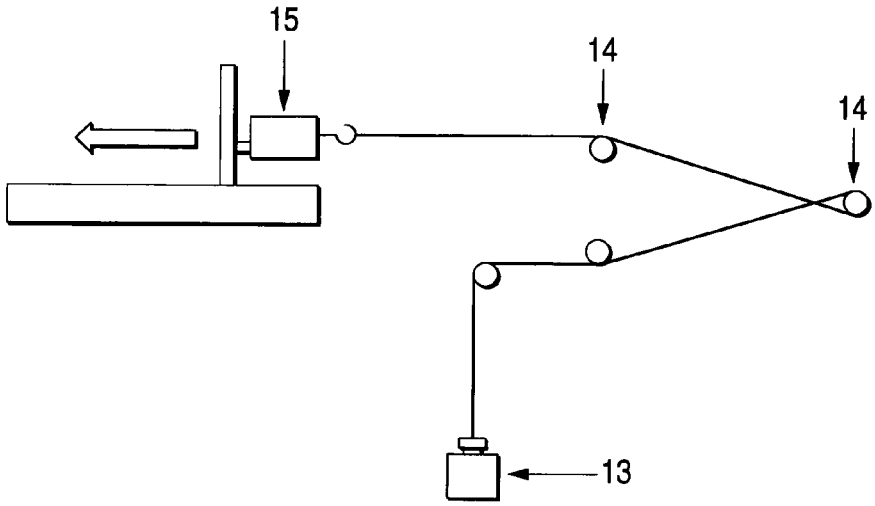
FIG. 3 is the schematic illustrating the determination of yarn-to-yarn frictional coefficient.

Yarn-To-Yarn Frictional Coefficient (F/Fμs):

As shown in FIG. 3, a 50 to 60-cm strand of elastic monofilament applied with a finish was connected with (13) a load, T1, on one end, arranged through (14) pulleys, connected to (15) a strain gauge on the other end, and pulled at a constant speed, for example 3 cm/min. The output tension, T2, was determined with (15) the strain gauge and calculated into yarn-to-yarn frictional coefficient by the formula, 1.

$$\text{Yarn-to-yarn frictional coefficient } (F/F\mu s)=1/\theta\cdot ln(T2/T1) \quad (1)$$

where θ=2π, ln was a natural logarithm, and T1 was 1 g per 22 dtex of yarn.

Package Buildup (Distortion of Yarn Wraps):

A 400-g package of elastic monofilament applied with a test finish was visually inspected whether the distortion of yarn wraps, such as bulge or cobwebbing, was found.

Figure 4:
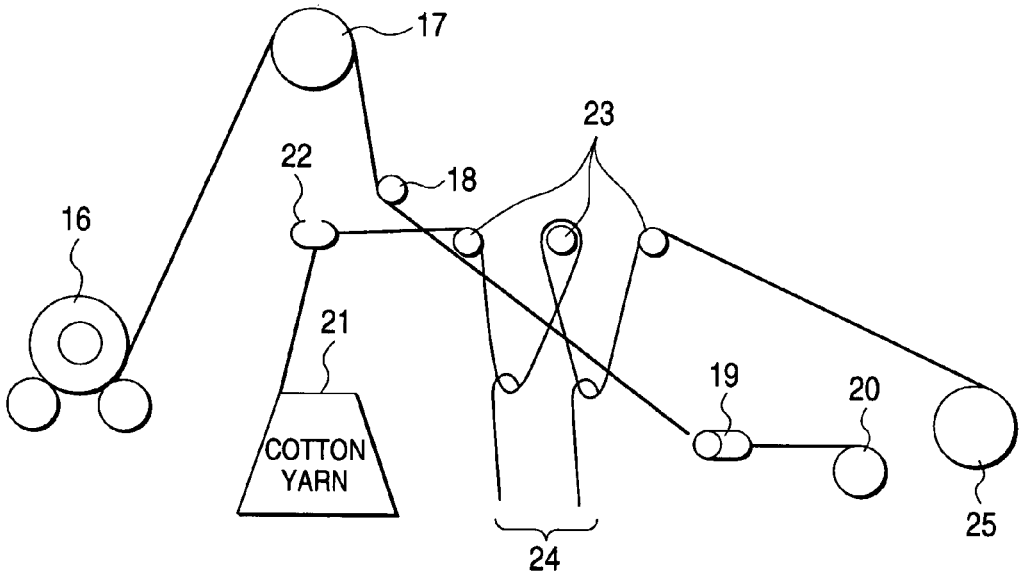
FIG. 4 is the schematic illustrating the determination of the quantity of deposited fly.

Fly Deposit:

An elastic yarn sample was released from (16) a package at 20 m/min, driven through (17) a compensator, (18) a pulley and (19) a clearer guide, and was wound onto (20) a winding roller at 80 m/min as shown in FIG. 4. Cotton spun yarn from (21) a package was driven through (22) a yarn guide, (23) pulleys and (24) knitting needles, and wound onto (25) a winding roller at 80 m/min. Fly from the cotton spun yarn was generated by rubbing the cotton spun yarn twisted with one turn between the (23) pulleys and (24) knitting needles. The weight of fly depositing at the clearer guide during 1-hour driving of the elastic fiber yarn was determined. Both of the elastic fiber yarn and cotton spun yarn were conditioned at 20° C. and RH 45% for 3 days before the testing. The testing was carried out at 20° C. and RH 45%. The clearer guide was made of alumina with 0.2-mm inside diameter and 10-mm length.

Figure 5:
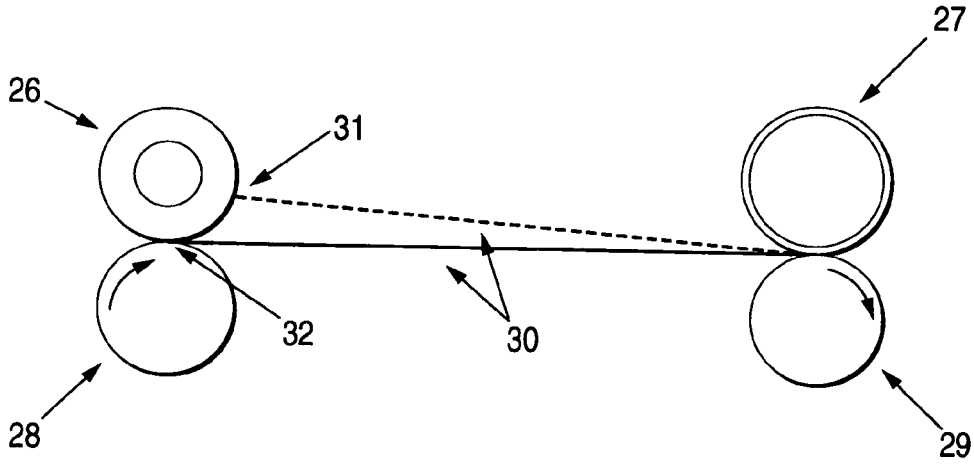
FIG. 5 is the schematic illustrating the determination of unwinding performance represented by the ratio of increased unwinding velocity to the initial unwinding velocity.

Unwinding Performance:

As shown in FIG. 5, (26) a package of elastic yarn applied with a test finish was placed on the unwinding roller of the unwinding speed testing device, and (27) a bobbing was placed on the winding roller. After controlling the rotating speed of (28) the unwinding roller and (29) the winding roller at the same speed, those two rollers were started simultaneously. Under such operational condition, almost no pulling force was applied to (30) the yarn on the package to let the yarn stick on the package with the stickiness on yarn surface, and thus (31) the unwinding point of the yarn from the package was kept at the point as shown in FIG. 5. The unwinding speed was controlled to fix (31) the unwinding point on (32) the contact point between the package and unwinding roller, because the unwinding point of the yarn from the package changed with changing the unwinding speed. The unwinding speed at which the unwinding point was kept at the contact point was detected and the difference between the unwinding and winding speed was calculated to represent the unwinding performance of the yarn by the following formula 2. Lower value indicates better unwinding performance of yarn.

$$\text{Unwinding Performance (\%)} =(\text{Winding speed}-\text{Unwinding speed})/\text{Unwinding speed}\times 100 \quad (2)$$

Skin Irritation:

Each of test finishes was dissolved in acetone with 2 weight percent and a piece of gauze (according to Japanese Pharmacopoeia) was immersed. After immersing for 30 minutes, the gauze was dried and cut into 1.5 cm squares. The cut pieces of the gauze were patched on the inside of the upper arms of testees for 48 hours. Then the pieces of the gauze were removed, and the state of the patched skin was inspected every 30 minutes and classified according to the standard shown in Table 1. The scores of each classification were summed and divided by the total number of the testees to determine the average score of each classification. The average scores from 0 to less than 1 are represented by ○, those from 1 to less than 2 are represented by Δ, and those of 2 or more are represented by X.

TABLE 1

| Classification (score) | Standard of classification |
|---|---|
| − (0) | No irritation |
| ± (0.5) | light erythema |
| I (1) | erythema |
| II (2) | erythema and edema |
| III (3) | erythema, edema and papula; serous papule; vesicle |
| VI (4) | bullous |

Preparation of Polymer Solution:

A 27-% polymer solution in dimethylformamide was prepared by reacting polytetramethyleneether glycol having a number-average molecular weight of 2000 and 4,4'-diphenylmethanediisocyanate in 1:2 mole ratio and by extending the polymer chain with 1,2-diaminopropane dissolved in dimethylformamide. The viscosity of the solution at 30° C. was 1500 mPaS.

Examples 1 to 5 and Comparative Examples 1 to 3

The polyurethane polymer solution was extruded in a current of nitrogen gas at 190° C. to dry-spin polyurethane filament. The extruded filament was applied with each of the finishes described in Table 4, where the ratio of the components were described on parts by weight basis, which were formulated with the components described in Table 2 and Table 3, with finish-application rollers by 6 weight percent of fiber, and finally wound onto a bobbin at 500 m/min into 400-g packages of 77 dtex monofilament yarn. The resultant package was conditioned at 35° C. and RH 50% for 48 hours before evaluation.

TABLE 2

| | Amino-modified silicones | |
|---|---|---|
| | Viscosity (@ 25° C., $mm^2/s$) | Amine value (KOHmg/g) |
| A-1 | 13 | 125 |
| A-2 | 1,100 | 33 |
| A-3 | 7,000 | 8 |
| A-4 | 20,000 | 31 |

TABLE 3

| | Phosphate esters | | |
|---|---|---|---|
| | Average carbon number of alkyl groups | Number of alkyl groups | Number of molecules of added oxyalkylene (oxyethylene) groups |
| B-1 | C14 | 1 to 2 | 0 |
| B-2 | C16 | 1 to 2 | 5 |

TABLE 4

| | | Examples | | | | | Comparative examples | | |
|---|---|---|---|---|---|---|---|---|---|
| Test number | | 1 | 2 | 3 | 4 | 5 | 1 | 2 | 3 |
| Finish | | A | B | C | D | E | F | G | H |
| Dimethyl silicone (15 $mm^2/s$) | | 95 | 50 | | 50 | | 60 | 50 | 40 |
| Liquid paraffin (Redwood 60 sec) | | | 40 | | 30 | 60 | | 50 | |
| Liquid paraffin (Redwood 80 sec) | | | | 60 | | 35 | 35 | | 40 |
| Isooctyl laurate | | | | 35 | 13 | | | | 20 |
| A-1 | | 3 | | | | 3 | | | |
| A-2 | | | 7 | | | | 5 | | |
| A-3 | | | | 4 | | | | | |
| A-4 | | | | | 5 | | | | |
| B-1 | | 2 | | 1 | | | | | |
| B-2 | | | 3 | | 2 | 2 | | | |
| Yarn tension | 10 m/min | 7.0 | 9.0 | 10.5 | 9.5 | 10.0 | 12.5 | 11.5 | 12.0 |
| in knitting (g) | 100 m/min | 16.5 | 19.5 | 21.5 | 20.0 | 21.0 | 25.5 | 23.5 | 24.5 |
| Static charge | 10 m/min | +0.05 | +0.1 | +0.3 | +0.2 | 0 | +4.0 | +3.5 | +3.0 |
| (kV) | 100 m/min | +0.1 | +0.1 | +0.3 | +0.2 | +0.05 | +6.3 | +5.8 | +5.5 |
| Static charge by roller (kV) | | +0.2 | +0.3 | +0.8 | +0.4 | +0.1 | +10.5 | +9.5 | +8.5 |
| Yarn-to-yarn frictional coefficient | | 0.31 | 0.30 | 0.27 | 0.29 | 0.28 | 0.17 | 0.19 | 0.18 |
| Defect in package buildup | | none | none | none | none | none | yes | none | yes |
| Fly deposit (mg) | | 0.6 | 0.7 | 1.4 | 0.9 | 0.5 | 10 | 6 | 5 |
| Unwinding performance | | 40 | 50 | 65 | 55 | 45 | 85 | 120 | 140 |
| Skin irritation | | ○ | ○ | ○ | ○ | ○ | Δ | ○ | ○ |

Examples 6 to 10 and Comparative Examples 4 to 6

The polyurethane polymer solution was extruded in a current of nitrogen gas at 190° C. to dry-spin polyurethane filament in the same manner as in Examples 1 to 5. The extruded filament was applied with each of the finishes described in Table 7, where the ratio of the components were described on parts by weight basis, which were formulated with the components described in Table 5 and Table 6, with finish-application rollers by 6 weight percent of fiber, and finally wound onto a bobbin at 500 m/min into a 400-g package of 77 dtex monofilament yarn. The resultant package was conditioned at 35° C. and RH 50% for 48 hours before evaluation.

TABLE 5

| | Amino-modified silicones | |
|---|---|---|
| | Viscosity (@ 25° C., $mm^2/s$) | Amine value (KOHmg/g) |
| A-5 | 5 | 122 |
| A-6 | 800 | 37 |
| A-7 | 5,000 | 11 |
| A-8 | 15,000 | 1 |

TABLE 6

| | Phosphate esters | | |
|---|---|---|---|
| | Average carbon number of alkyl groups | Number of alkyl groups | Number of molecules of added oxyalkylene (oxyethylene) groups |
| B-3 | C18 | 1 to 2 | 0 |
| B-4 | C16 | 1 to 2 | 15 |

Preparation of Polymer Solution:

One hundred parts by weight of polytetramethylene glycol having a number-average molecular weight of 2000 and 25 parts by weight of 4,4'-diphenylmethanediisocyanate were reacted at 70° C., and 250 parts by weight of N,N'-dimethylacetoamide was added to cool and dissolve the reacted product. A mixture prepared by dissolving 5 parts by weight of 1,2-diaminopropane in 184 parts by weight of N,N'-dimethylacetoamide was added and 0.2 weight percent of dimethyl silicone having a viscosity of 10000 $mm^2/s$ was added. The polyurethane polymer solution prepared in this manner was extruded through a spinneret having four spinneret holes in a current of nitrogen gas at 180° C. to dry-spin polyurethane filament. The extruded filament was applied with each of the finishes described in Table 8, which were formulated with the components described in Table 2 and Table 3, with finish-application rollers by 6 weight percent of fiber, and finally wound onto a bobbin at 500 m/min into a 400-g package of 44 dtex multifilament yarn. The resultant package was conditioned at 35° C. and RH 50% for 48 hours before evaluation.

TABLE 7

| | | Examples | | | | | Comparative examples | | |
|---|---|---|---|---|---|---|---|---|---|
| Test number | | 6 | 7 | 8 | 9 | 10 | 4 | 5 | 6 |
| Finish | | I | J | K | L | M | N | O | P |
| Dimethyl silicone (15 $mm^2/s$) | | 94 | 50 | | 50 | | 60 | 50 | 40 |
| Liquid paraffin (Redwood 60 sec) | | | 39 | | 30 | 60 | | 50 | |
| Liquid paraffin (Redwood 80 sec) | | | | 58 | | 35 | 35 | | 40 |
| Isooctyl laurate | | | | 30 | 15.9 | | | | 20 |
| A-5 | | 3 | | | | | 5 | | |
| A-6 | | | 6 | | | | | | |
| A-7 | | | | 11 | | 4 | | | |
| A-8 | | | | | 4 | | | | |
| B-3 | | 3 | | 1 | | | | | |
| B-4 | | | 5 | | 0.1 | 1 | | | |
| Yarn tension | 10 m/min | 7.0 | 7.5 | 9.0 | 8.5 | 10.5 | 12.0 | 11.5 | 12.0 |
| in knitting (g) | 100 m/min | 16.0 | 16.5 | 19.0 | 18.5 | 21.0 | 24.0 | 23.5 | 24.5 |
| Static charge | 10 m/min | 0 | +0.05 | +0.2 | +0.3 | +0.4 | +4.3 | +3.7 | +3.2 |
| (kV) | 100 m/min | +0.05 | +0.1 | +0.2 | +0.4 | +0.5 | +6.7 | +6.1 | +5.2 |
| Static charge by roller (kV) | | +0.1 | +0.2 | +0.5 | +0.7 | +1.3 | +10.7 | +9.7 | +8.3 |
| Yarn-to-yarn frictional coefficient | | 0.30 | 0.29 | 0.28 | 0.26 | 0.24 | 0.17 | 0.19 | 0.18 |
| Defect in package buildup | | none | none | none | none | none | yes | none | yes |
| Fly deposit (mg) | | 0.8 | 0.6 | 1.0 | 1.4 | 1.7 | 1.2 | 6 | 5 |
| Unwinding performance | | 40 | 55 | 65 | 60 | 70 | 80 | 120 | 140 |
| Skin irritation | | ○ | ○ | ○ | ○ | ○ | Δ | ○ | ○ |

Examples 11 to 15 and Comparative Examples 7 to 9

TABLE 8

| | Examples | | | | | Comparative examples | | |
|---|---|---|---|---|---|---|---|---|
| Test number | 11 | 12 | 13 | 14 | 15 | 7 | 8 | 9 |
| Finish | O | P | Q | R | S | T | U | V |
| Dimethyl silicone (5 $mm^2/s$) | 80 | 49.5 | 59.9 | 49.5 | | | 60 | 70 |
| Liquid paraffin (Redwood 40 sec) | | 40 | | 30 | 60 | | | |
| Liquid paraffin (Redwood 60 sec) | 13 | | 30 | | 34 | 60 | 37.9 | 29.5 |
| Isooctyl stearate | | | | 13 | | 33.7 | | |
| A-1 | 3 | | | | 3 | | | |
| A-2 | | 7 | | | | | | |
| A-3 | | | | | | 5 | | |
| A-4 | | | 5 | 5 | | | | |
| B-1 | 2 | | | | | | | |
| B-2 | | 3 | 2 | 2 | 2 | | | |

TABLE 8-continued

| Test number | Examples 11 | 12 | 13 | 14 | 15 | Comparative examples 7 | 8 | 9 |
|---|---|---|---|---|---|---|---|---|
| Sodium isostearate | | | 1.0 | | 0.5 | 1.0 | | |
| Aluminum stearate | 2 | | 1.8 | | | | 1.8 | |
| Carboxy-modified silicone (BY-16-750) | | | 0.3 | | | 0.3 | 0.3 | |
| Polyether-modified silicone (KF-351) | | | | 0.5 | | | | 0.5 |
| MQ-type silicone resin (TSF 4600) | | 0.5 | | | 0.5 | | | |
| Yarn tension 10 m/min | 7.0 | 9.0 | 9.5 | 9.0 | 10.0 | 11.0 | 10.0 | 9.0 |
| in knitting (g) 100 m/min | 16.5 | 18.5 | 19.5 | 19.0 | 21.5 | 22.0 | 20.0 | 18.0 |
| Static charge 10 m/min | 0 | 0 | +0.1 | +0.1 | 0 | +1.5 | +1.9 | +2.0 |
| (kV) 100 m/min | 0 | +0.1 | +0.1 | +0.2 | 0 | +1.5 | +3.0 | +3.2 |
| Static charge by roller (kV) | +0.05 | +0.1 | +0.2 | +0.3 | 0 | +2.5 | +6.5 | +5.0 |
| Yarn-to-yarn frictional coefficient | 0.31 | 0.30 | 0.29 | 0.29 | 0.28 | 0.18 | 0.20 | 0.21 |
| Defect in package buildup | none | none | none | none | none | yes | none | none |
| Fly deposit (mg) | 0.4 | 0.5 | 0.7 | 0.9 | 0.3 | 3.5 | 4 | 5 |
| Unwinding performance | 30 | 40 | 40 | 50 | 35 | 65 | 85 | 115 |
| Skin irritation | ○ | ○ | ○ | ○ | ○ | ○ | ○ | ○ |

In Table 8, the following products were employed as the carboxy-modified silicone, polyether-modified silicone, and MQ-type silicone resin.

Carboxy-modified silicone: BY-16-750, Toray Dow-Corning Silicone Co., Ltd.

Polyether-modified silicone: KF-351, Shin-Etsu Chemical Co., Ltd.

MQ-type silicone resin: TSF 4600, Toshiba Silicone Co., Ltd.

The above description applies to Table 9 and Table 13.

Examples 16 to 20 and Comparative Examples 10 to 12

Preparation of Polymer Solution:

One hundred parts by weight of polytetramethylene glycol having a number-average molecular weight of 2000 and 25 parts by weight of 4,4'-diphenylmethane diisocyanate were reacted at 70° C., and 250 parts by weight of N,N'-dimethylacetoamide was added to cool and dissolve the reacted product. A mixture prepared by dissolving 5 parts by weight of 1,2-diaminopropane in 184 parts by weight of N,N'-dimethylacetoamide was added and 0.2 weight percent of dimethyl silicone having a viscosity of 10000 $mm^2/s$ was added. The polyurethane polymer solution prepared in this manner was extruded through a spinneret having four spinneret holes in a current of nitrogen gas at 180° C. to dry-spin polyurethane filament. The extruded filament was applied with each of the finishes described in Table 9, which were formulated with the components described in Table 5 and Table 6, with finish-application rollers by 6 weight percent of fiber, and finally wound onto a bobbin at 500 m/min into a 400-g package of 44 dtex multifilament yarn. The resultant package was conditioned at 35° C. and RH 50% for 48 hours before evaluation.

TABLE 9

| Test number | Examples 16 | 17 | 18 | 19 | 20 | Comparative examples 10 | 11 | 12 |
|---|---|---|---|---|---|---|---|---|
| Finish | W | Y | Z | A' | B' | C' | U | V |
| Dimethyl silicone (5 $mm^2/s$) | 80 | 48.5 | 62.8 | 52.4 | | | 60 | 70 |
| Liquid paraffin (Redwood 40 sec) | | 40 | | 30 | 60 | | | |
| Liquid paraffin (Redwood 60 sec) | 12 | | 30 | | 34 | 60 | 37.9 | 29.5 |
| Isooctyl stearate | | | | 13 | | 33.7 | | |
| A-5 | 3 | | | | | | | |
| A-6 | | 6 | | | | 5 | | |
| A-7 | | | | | 4 | | | |
| A-8 | | | 4 | 4 | | | | |
| B-3 | 3 | | | | | | | |
| B-4 | | 5 | 0.1 | 0.1 | 1 | | | |
| Sodium isostearate | | | 1.0 | | 0.5 | 1.0 | | |
| Aluminum stearate | 2 | | 1.8 | | | | 1.8 | |
| Carboxy-modified silicone (BY-16-750) | | | 0.3 | | | 0.3 | 0.3 | |
| Polyether-modified silicone (KF-351) | | | | 0.5 | | | | 0.5 |
| MQ-type silicone resin (TSF 4600) | | 0.5 | | | 0.5 | | | |
| Yarn tension 10 m/min | 7.0 | 8.0 | 8.5 | 8.0 | 10.5 | 12.0 | 11.0 | 10.5 |
| in knitting (g) 100 m/min | 16.5 | 17.0 | 18.5 | 17.5 | 21.5 | 23.5 | 21.5 | 19.5 |
| Static charge 10 m/min | 0 | 0 | +0.2 | +0.2 | +0.3 | +1.3 | +2.3 | +2.7 |

TABLE 9-continued

| Test number | Examples 16 | 17 | 18 | 19 | 20 | Comparative examples 10 | 11 | 12 |
|---|---|---|---|---|---|---|---|---|
| (kV) 100 m/min | 0 | +0.1 | +0.2 | +0.3 | +0.3 | +1.4 | +3.4 | +3.5 |
| Static charge by roller (kV) | +0.05 | +0.1 | +0.4 | +0.6 | +0.8 | +2.3 | +6.3 | +5.1 |
| Yarn-to-yarn frictional coefficient | 0.30 | 0.29 | 0.26 | 0.26 | 0.24 | 0.17 | 0.20 | 0.21 |
| Defect in package buildup | none | none | none | none | none | yes | none | none |
| Fly deposit (mg) | 0.5 | 0.4 | 1.0 | 1.2 | 1.3 | 3 | 4 | 5 |
| Unwinding performance | 30 | 40 | 45 | 55 | 55 | 60 | 85 | 115 |
| Skin irritation | ○ | ○ | ○ | ○ | ○ | Δ | ○ | ○ |

Examples 21 to 24 and Comparative Examples 13 to 16

Preparation of Polymer Solution:

One hundred parts by weight of polytetramethylene glycol having a number-average molecular weight of 2000 and 25 parts by weight of 4,4'-diphenylmethanediisocyanate were reacted at 70° C., and 250 parts by weight of N,N'-dimethylacetoamide was added to cool and dissolve the reacted product. A mixture prepared by dissolving 5 parts by weight of 1,2-diaminopropane in 184 parts by weight of N,N'-dimethylacetoamide was added. The polyurethane polymer solution prepared in this manner was extruded through a spinneret having two spinneret holes in a current of nitrogen gas at 190° C. to dry-spin polyurethane filament. The extruded filament was applied with each of the finishes described in Table 12, which were formulated with the components described in Table 10 and Table 11, with finish-application rollers by 6 weight percent of fiber, and finally wound onto a bobbin at 400 m/min into a 400-g package of 22 dtex multifilament yarn. The resultant package was conditioned at 35° C. and RH 50% for 48 hours before evaluation.

TABLE 10

| | Amino-modified silicones | |
|---|---|---|
| | Viscosity (@ 25° C., $mm^2/s$) | Amine value (KOHmg/g) |
| A-9 | 60 | 9 |
| A-10 | 72 | 25 |
| A-11 | 1,200 | 5 |
| A-12 | 1,400 | 14 |

TABLE 11

| | Phosphate esters | | |
|---|---|---|---|
| | Average carbon number of alkyl groups | Number of alkyl groups | Number of molecules of added oxyalkylene (oxyethylene) groups |
| B-5 | iso-C18 | 1 to 2 | 0 |
| B-6 | C6 | 1 to 2 | 0 |

TABLE 12

| Test number | Examples 21 | 22 | 23 | 24 | Comparative examples 13 | 14 | 15 | 16 |
|---|---|---|---|---|---|---|---|---|
| Finish | D' | E' | F' | G' | H' | I' | J' | K' |
| Dimethyl silicone (10 $mm^2/s$) | 94 | 82 | 67 | 62.5 | 20 | 45 | 50 | 70 |
| Liquid paraffin (Redwood 40 sec) | | | 30 | | | 50 | | 30 |
| Liquid paraffin (Redwood 60 sec) | | 12 | | 20 | 40 | | 50 | |
| Isooctyl stearate | | | | 10 | 30 | | | |
| A-9 | 5.7 | | | | | | | |
| A-10 | | 5.3 | | | 10 | | | |
| A-11 | | | 2.96 | | | | | |
| A-12 | | | | 7.2 | | | | |
| B-5 | 0.3 | 0.7 | | | | 5 | | |
| B-6 | | | 0.04 | 0.3 | | | | |
| Yarn tension 10 m/min | 6.0 | 5.5 | 7.0 | 8.0 | 10.0 | 12.5 | 11.0 | 10.5 |
| in knitting (g) 100 m/min | 15.0 | 14.5 | 16.5 | 17.5 | 20.5 | 24.0 | 23.0 | 21.5 |
| Static charge 10 m/min | +0.2 | +0.3 | 0 | 0 | +2.7 | +3.6 | +3.8 | +4.3 |
| (kV) 100 m/min | +0.3 | +0.4 | +0.05 | 0 | +3.9 | +6.0 | +6.3 | +7.7 |
| Static charge by roller (kV) | +0.5 | +0.9 | +0.1 | 0 | +6.6 | +9.7 | +10.3 | +11.5 |
| Yarn-to-yarn frictional coefficient | 0.29 | 0.30 | 0.28 | 0.27 | 0.15 | 0.20 | 0.20 | 0.21 |
| Defect in package buildup | none | none | none | none | yes | none | none | none |
| Fly deposit (mg) | 1.1 | 1.5 | 0.5 | 0.3 | 4.5 | 8 | 11 | 13 |
| Unwinding performance | 50 | 50 | 60 | 55 | 100 | 120 | 130 | 120 |
| Skin irritation | ○ | ○ | ○ | ○ | Δ | ○ | ○ | ○ |

vExamples 25 to 28 and Comparative Examples 17 to 20

Preparation of Polymer Solution:

One hundred parts by weight of polytetramethylene glycol having a number-average molecular weight of 2000 and 25 parts by weight of 4,4'-diphenylmethanediisocyanate were reacted at 70° C., and 250 parts by weight of N,N'-dimethylacetoamide was added to cool and dissolve the reacted product. A mixture prepared by dissolving 5 parts by weight of 1,2-diaminopropane in 184 parts by weight of N,N'-dimethylacetoamide was added. The polyurethane polymer solution prepared in this manner was extruded through a spinneret having two spinneret holes in a current of nitrogen gas at 190° C. to dry-spin polyurethane filament. The extruded filament was applied with each of the finishes described in Table 13, which were formulated with the components described in Table 10 and Table 11, with finish-application rollers by 6 weight percent of fiber, and finally wound onto a bobbin at 400 m/min into a 400-g package of 22 dtex multifilament yarn. The resultant package was conditioned at 35° C. and RH 50% for 48 hours before evaluation.

TABLE 13

| | Examples | | | | Comparative examples | | | |
|---|---|---|---|---|---|---|---|---|
| Test number | 25 | 26 | 27 | 28 | 17 | 18 | 19 | 20 |
| Finish | L' | M' | N' | O' | P' | Q' | R' | S' |
| Dimethyl silicone (10 $mm^2/s$) | 92 | 81.5 | 64.7 | 61.7 | 20 | 45 | 49 | 69.7 |
| Liquid paraffin (Redwood 40 sec) | | | 30 | | | 49.5 | | 30 |
| Liquid paraffin (Redwood 60 sec) | | 12 | | 20 | 39.2 | | 50 | |
| Isooctyl stearate | | | | 10 | 30 | | | |
| A-9 | 5.7 | | | | | | | |
| A-10 | | 5.3 | | | 10 | | | |
| A-11 | | | 2.96 | | | | | |
| A-12 | | | | 7.2 | | | | |
| B-5 | 0.3 | 0.7 | | | | 5 | | |
| B-6 | | | 0.04 | 0.3 | | | | |
| Magnesium stearate | 2 | | 1.8 | | 0.5 | | 0.5 | |
| Carboxy-modified silicone ((BY-16-750) | | | | 0.3 | 0.3 | | | 0.3 |
| Polyether-modified silicone (KF-351) | | | 0.5 | | | 0.5 | | |
| MQ-type silicone resin (TSF 4600) | | 0.5 | | 0.5 | | | 0.5 | |
| Yarn tension 10 m/min | 6.0 | 6.0 | 6.5 | 8.0 | 9.5 | 11.0 | 11.5 | 9.5 |
| in knitting (g) 100 m/min | 15.0 | 15.0 | 15.5 | 18.0 | 20.0 | 23.0 | 24.5 | 20.5 |
| Static charge 10 m/min | +0.2 | +0.3 | 0 | 0 | +2.4 | +3.2 | +3.5 | +4.0 |
| (kV) 100 m/min | +0.2 | +0.3 | 0 | 0 | +3.3 | +5.6 | +5.9 | +6.8 |
| Static charge by roller (kV) | +0.4 | +0.8 | 0 | 0 | +6.1 | +9.1 | +9.7 | +10.0 |
| Yarn-to-yarn frictional coefficient | 0.29 | 0.30 | 0.28 | 0.27 | 0.15 | 0.19 | 0.20 | 0.21 |
| Defect in package buildup | none | none | none | none | yes | none | none | none |
| Fly deposit (mg) | 0.8 | 1.3 | 0.3 | 0.2 | 4.0 | 7 | 9 | 11 |
| Unwinding performance | 40 | 35 | 50 | 40 | 95 | 115 | 110 | 115 |
| Skin irritation | ○ | ○ | ○ | ○ | Δ | ○ | ○ | ○ |

APPLICATION IN INDUSTRIAL FIELD

The finishes of the present invention impart stable antistaticity, superior unwinding and package buildup performance, and sufficient lubricity to elastic fiber. In addition, the finishes minimize cotton fly sticking on elastic fiber yarn to minimize ends down in knitting operation of elastic yarn and cotton yarn, and thus contribute to improved knitting efficiency and fabric quality.

The invention claimed is:

1. Finishes for elastic fiber containing 80 to 99.99 parts by weight of at least one base component selected from the group consisting of silicone oils, mineral oils and ester oils, 0.01 to 10 parts by weight of an amino-modified silicone, and 0.0001 to 10 parts by weight of a phosphate ester containing an acidic hydroxyl group and at least one hydrocarbon group or oxyalkylene group per a molecule, wherein a mole ratio of an amino group contained in said amino-modified silicone to the acidic hydroxyl group contained in said phosphate ester ranges from 0.8 to 1.2.

2. The finishes according to claim 1, further containing 0.01 to 15 parts by weight of at least one of polyether-modified silicones, carboxy-modified silicones, metallic soaps and silicone resins.

3. Elastic fiber, wherein 0.1 to 15 weight percent of one of the finishes according to claim 1 is applied.

4. The finishes for elastic fiber according to claim 1 wherein the metallic soaps are selected from the group consisting of aluminum stearate, calcium stearate, magnesium stearate, barium stearate, and zinc stearate.

5. Finishes for elastic fiber containing 80 to 99.99 parts by weight of at least one base component selected from the group consisting of silicone oils, mineral oils and ester oils, 0.01 to 10 parts by weight of an amino-modified silicone and 0.0001 to 10 parts by weight of a phosphate ester containing an acidic hydroxyl group and at least one hydrocarbon group or oxyalkylene group per a molecule, wherein the phosphate ester is at least one member selected from the group consisting of: monomethyl phosphate, dimethyl phosphate, oleyl phosphate, 2-ethylhexyl phosphate, butyl phosphate, benzyl phosphate, octyiphenyl phosphate, cyclohexyl phosphate, POE (2) POP (5) phosphate, a phosphate having one to two alkyl groups having an average carbon number of 14, a phosphate having one to two alkyl groups having an average carbon number of 18, a phosphate having one to two alkyl groups which have an average carbon number of 16 and to which 15 moles of oxyethylene groups are added, a phosphate having one to two iso-alkyl groups having an average carbon number of 18, and a phosphate having one to two alkyl groups having an average carbon number of 6, wherein a mole ratio of an amino group contained in said amino-modified silicone to the acidic hydroxyl group contained in said phosphate ester ranges from 0.8 to 1.2.

6. The finishes according to claim 5, further containing 0.01 to 15 parts by weight of at least one of polyether-modified silicones, carboxy-modified silicones, metallic soaps and silicone resins.

7. The finishes according to claim 6, wherein the metallic soaps are selected from the group consisting of aluminum stearate, calcium stearate, magnesium stearate, barium stearate, and zinc stearate.

8. Elastic fiber, wherein 0.1 to 15 weight percent of one of the finishes according to claim 5 is applied.

9. Finishes for elastic fiber containing 80 to 99.99 parts by weight of at least one base component selected from the group consisting of silicone oils, mineral oils and ester oils, 0.01 to 10 parts by weight of an amino-modified silicone and 0.000 1 to 10 parts by weight of a phosphate ester containing at least one hydrocarbon group or oxyalkylene group per a molecule, wherein an amino group in the amino-modified silicone is neutralized with an acidic hydroxyl group in the phosphate ester, wherein a mole ratio of an amino group contained in said amino-modified silicone to an acidic hydroxyl group contained in said phosphate ester ranges from 0.8 to 1.2.

10. The finishes according to claim 9, further containing 0.01 to 15 parts by weight of at least one of polyether-modified silicones, carboxy-modified silicones, metallic soaps and silicone resins.

11. The finishes for elastic fiber according to claim 10, wherein the metallic soaps are selected from the group consisting of aluminum stearate, calcium stearate, magnesium stearate, barium stearate, and zinc stearate.

12. Elastic fiber, wherein 0.1 to 15 weight percent of one of the finishes according to claim 9 is applied.

13. Finishes for elastic fiber containing 80 to 99.99 parts by weight of at least one base component selected from the group consisting of silicone oils, mineral oils and ester oils, 0.01 to 10 parts by weight of an amino-modified silicone, 0.0001 to 10 parts by weight of a phosphate ester containing an acidic hydroxyl group and at least one hydrocarbon group or oxyalkylene group per a molecule, and 0.01 to 15 parts by weight of at least one of polyether-modified silicones, carboxy-modified silicones, metallic soaps and silicone resins, wherein a mole ratio of an amino group contained in said amino-modified silicone to the acidic hydroxyl group contained in said phosphate ester ranges from 0.8 to 1.2.

14. Elastic fiber, wherein 0.1 to 15 weight percent of one of the finishes according to claim 13 is applied.

15. The finishes for elastic fiber according to claim 13, wherein the metallic soaps are selected from the group consisting of aluminum stearate, calcium stearate, magnesium stearate, barium stearate, and zinc stearate.

* * * * *